US005775269A

United States Patent [19]

Lawrence

[11] Patent Number: 5,775,269

[45] Date of Patent: Jul. 7, 1998

[54] BOILER PROTECTION TUBE ASSEMBLY

[75] Inventor: Howard John Lawrence, White Rock, Canada

[73] Assignee: Industrial Ceramics Limited, Milton, Canada

[21] Appl. No.: 679,305

[22] Filed: Jul. 12, 1996

[30] Foreign Application Priority Data

Jun. 7, 1996 [CA] Canada ..... 2178524

[51] Int. Cl.[6] ..... F22B 37/06

[52] U.S. Cl. ..... 122/511; 122/512; 165/134.1

[58] Field of Search ..... 122/511, 512; 110/322, 323; 165/134.1

[56] References Cited

U.S. PATENT DOCUMENTS

| | | | |
|---|---|---|---|
| 911,397 | 2/1909 | Howell | 122/512 |
| 3,317,222 | 5/1967 | Maretzo | 165/134.1 |
| 3,451,472 | 6/1969 | Keck | 165/134.1 |
| 4,028,789 | 6/1977 | Loch | 29/157.4 |
| 4,176,612 | 12/1979 | Speer | 110/323 |
| 4,336,770 | 6/1982 | Kaneko et al. | 165/134 R |
| 4,433,644 | 2/1984 | Fitzpatrick | 110/323 |
| 4,441,544 | 4/1984 | McCurley | 122/512 |
| 4,706,743 | 11/1987 | Chalimbaud | 165/134.1 |
| 5,350,011 | 9/1994 | Sylvester | 122/511 |
| 5,647,432 | 7/1997 | Rexford et al. | 165/134.1 |

*Primary Examiner*—Henry A. Bennett
*Assistant Examiner*—Gregory Wilson
*Attorney, Agent, or Firm*—Rogers & Milne

[57] ABSTRACT

A boiler protection tube assembly having an inner ceramic sleeve, a ceramic block and an outer ceramic sleeve. The inner ceramic sleeve is of a high-strength, heat resistant ceramic material with at least moderate thermal shock resistance. The outer ceramic sleeve is of a heat resistant, insulating ceramic fiber and extends around the outer sleeve along its length. The inner and outer sleeve are insertable through a hole which extends through the ceramic block into an end of a condenser tube of a tube sheet boiler. The outer ceramic sleeve reduces heat flow between the inner ceramic sleeve and both of the ceramic block and the condenser tube. The ceramic block has a plurality of side faces generally perpendicular to the inner and outer faces to enable the blocks to be installed with side faces adjacent to corresponding side faces of adjacent blocks.

8 Claims, 4 Drawing Sheets

BOILER PROTECTION TUBE ASSEMBLY

FIELD OF THE INVENTION

This invention relates generally to tube sheet boilers and more particularly to ceramic boiler protection tubes.

BACKGROUND

FIG. 1*a* is a cross-sectional view schematically illustrating a tube sheet boiler. FIG. 1*b* illustrates in more detail the encircled area 1*b* in FIG. 1*a* which is typically protected by ceramic boiler protection tubes. FIGS. 1*c*, *d* and *f* are cross-sectional views illustrating prior art ceramic boiler protection tube assemblies. FIG. 1*e* is a perspective view of a ceramic boiler protection tube arrangement.

A typical tube sheet boiler ("boiler") is generally identified by reference 10 in FIG. 1. Such a boiler is used in the production of sulphur by combustion of hydrogen sulphide. Reactants are introduced into a combustion zone 12 through a burner 14 and burned in the combustion zone 12. Reaction products, indicated by arrows 16 pass through condenser tubes 18, are cooled and condense as shown by droplets 20 and exit the boiler as a liquid through an outlet 22. A coolant, such as water, is circulated around the condenser tubes 18. The coolant flow is represented by arrows 24 which show the coolant entering a coolant inlet 26 and exiting a coolant outlet 28.

In order to maintain a water jacket around the condenser tubes 18 and prevent coolant 24 from intermingling with the reaction products 16, the condenser tubes 18 are mounted between tube sheets 30 and 32. The ends of the condenser tubes 18 are welded to the tube sheets 30 and 32 and the tube sheets 30 and 32 are sealed to an outer shell 34 of the boiler 10.

The joinder of a condenser tube 18 to the tube sheet 30 is shown in more detail in FIG. 1*b*. As illustrated, the joinder is effected by a weld seam 36 extending around the perimeter of the tube 18. As also illustrated, the tube sheet 30 is considerably thicker than the condenser tube 18 which is necessitated by strength requirements for the tube sheet 30. The condenser tubes 18 and the tube sheet 30 would typically be made from steel.

In the case of sulfur production, it is desirable to maintain the temperature of the condenser tubes 18 and the tube sheets 30 and 32 below about 650° F. (350° C.) above which $H_2S$ starts to vigorously attack carbon steel. Staying below this temperature does not pose a significant problem as one progresses away from the combustion zone 12 because of the coolant flow around the condenser tubes 18 but it poses a significant problem adjacent the combustion zone 12, particularly in the region of the welds 36. The region of the welds 36 tends to be the hottest as that region is furthest from the flow of coolant.

Various arrangements have been used to shield the tube sheet 30 and the condenser tubes 18. FIG. 1*c* illustrates shielding of an outer or "hot" face 38 of the tube sheet 30 using a flanged ceramic sleeve 40 and a refectory castable 42. The flanged sleeve 40 is commonly referred to as a "boiler protection tube" and the latter expression will therefore be used below.

The boiler protection tube 40 is a generally cylindrical tube that has an outwardly extending flange or ferrule 44 part way along its length to limit its depth of insertion into the condenser tube 18. Once all of the boiler protection tubes 40 have been inserted into the respective condenser tubes 18, a refractory castable 42 is poured around the exposed ends of the boiler protection tubes 40 to cover the hot face 38 of the tube sheet 30 between the boiler protection tubes 40.

Disadvantages associated with using refractory castables include the time and mess associated with installation, the time required to cure the castable, the possibility of voids, the possibility of differing thermal expansion rates between the castable and the boiler protection tube and shrinkage stresses arising from shrinkage of the castable upon firing. Furthermore, the boiler protection tubes cannot be readily removed from the tube sheet for inspection or replacement without removing the entire tube sheet refractory or collapsing the refractory face.

FIG. 1*d* illustrates an alternate embodiment in which the boiler protection tube 40 has an enlarged head 46 in place of the ferrule 44 in the FIG. 1*c* embodiment. The head 46 may be of square or hexagonal cross-section to coincide with the arrangement of the condenser tubes 18 and sized so as to nest with the sides of adjacent heads 46 in an arrangement analogous to that shown in FIG. 1*e*. The space between adjacent faces of adjacent heads 46 may be filled with a refractory mortar or with a ceramic fiber insulation 50 as shown in FIG. 1*e*. Ceramic fiber insulation 50 may also be mounted between the hot face 30 and the heads 46 as shown in FIG. 1*e*.

FIGS. 1*e* and *f* illustrate a boiler protection tube assembly somewhat like the FIG. 1*d* embodiment described above but differing primarily in that it is made up of two components, a hexagonal block 54 and a cylindrical sleeve 56. The block 54 corresponds to the head 46 of the FIG. 1*d* embodiment and the sleeve 56 corresponds to the boiler protection tube 40 in the FIGS. 1*c* and *d* embodiments.

The sleeve 56 is inserted through a cylindrical aperture 58 in the block 54. The sleeve 56 has a flanged end 60 which nests within a correspondingly shaped recess 62 in the block 54 to limit the distance that the sleeve 56 can be inserted into the condenser tube 18. Ceramic fiber insulation 50 may be wrapped around the sleeve 56 to axially locate the sleeve 56 within the condenser tube 18. Ceramic fiber insulation 50 may also be placed between the hot face 38 of the tube sheet 30 and between the blocks 54. The ceramic fiber insulation 50 acts as a gasket to seal the overall structure, to prevent direct flame or hot gas impingement on the hot face 38 of the tube sheet 30 and reduces heat flow from the boiler protection tube assembly 52 into the tube sheet 30 and condenser tubes 18.

The block 54 may be provided with a further recess 64 around the edge of the aperture 58 opposite the recess 62 to provide space for the weld seam 36 and the adjacent end of the condenser tube 18 which may, as illustrated, project from the hot face 38 of the tube sheet 30.

An advantage to the FIG. 1*f* assembly is that each of the two separate components (i.e. the block 50 and the sleeve 56) may be better and more efficiently manufactured than a one component structure such as in FIG. 1*d*. One reason for this is that each component is of less wall thickness than the combined structure while presenting more surface area therefore facilitating drying and firing during manufacture.

Another advantage to the FIG. 1*f* embodiment is that thermal stresses arising from the different heating and cooling rates attributable to varying component thicknesses are avoided. The FIG. 1*d* structure is prone to suffer thermal stress induced cracking at the juncture of the head 46 and the boiler protection tube 40. Also the assembly of FIG. 1*f* enables removal of the sleeve 56 without disturbing the refractory adjacent the hot face 38 which is particularly useful if the blocks 54 are mortared together.

Despite the use of boiler protection tubes of the types described above, tube sheet boilers still generally wear out at the juncture of the condenser tubes 18 and the tube sheet 30.

Failure of prior boiler protection tube arrangements generally arises from vibration, thermal stresses and tube sheet flexure. The prior arrangements such as illustrated in FIG. 1*c* are typically the most prone to failure because the ceramic sleeves 40 are not free to move relative to the refractory castable 42 to take up any movement of the refractory castable 42 resulting from thermal expansion, vibration or tube sheet flexure.

The alternate embodiment illustrated it FIG. 1*d* is an improvement over the FIG. 1*c* embodiment in that the sides of the heads 46 are separated thereby permitting the boiler protection tubes 40 to move relative to each other. The FIG. 1*d* embodiment is therefore better able to deal with stresses arising from tube sheet movement and avoids the stresses associated with having the ends of the boiler protection tubes surrounded by a monolithic refractory. Nevertheless, the FIG. 1*d* embodiment is still prone to failure caused by vibration or by thermal stresses. The weight of each head 46 is substantial considering the relatively thin wall of the tube 40 which must support it. Vibration of the head 46 causes further force to be exerted upon the tube 40 which may cause cracking in the region of the face 36.

The cooling of the condenser tubes 18 will result in the portion of the boiler protection tube 40 extending into the condenser tubes 18 being cooler than the remainder of the boiler protection tubes 40 which are not cooled and are surrounded by a refractory material of relatively low thermal conductivity (compared to the steel structure). The temperature differential along the length of the boiler protection tube 40 generates stresses arising from the accompanying different amounts of thermal expansion which can cause cracking of the boiler protection tube 40 in the vicinity of the tube sheet 30.

The FIG. 1*f* embodiment is less prone to thermal stress related cracking in the vicinity of the tube sheet 40 because of the layer of ceramic fiber insulation separating the boiler protection tube 40 from the condenser tube 18. The ceramic fiber insulation 50 reduces heat loss from the boiler protection tube 40 into the condenser tube 18 thereby maintaining a higher temperature in the portion of the boiler protection tube 40 extending into the condenser tube 18. This reduces the thermal gradient along the boiler protection tube 40 thereby reducing the likelihood of thermal stress induced cracking of the boiler protection tube 40 adjacent the tube sheet 30.

Although the FIG. 1*f* embodiment may at first glance appear to be less prone to vibration damage than the FIG. 1*d* embodiment, in practice the improvement, if any, is not very significant. Although the head 54 in the FIG. 1*f* embodiment is free to move slightly relative to the boiler protection tube 56, the weight of the head must still be substantially borne by the boiler protection tube 56.

It is an object of the present invention to provide a boiler protection tube assembly which is easy to install, withstands vibration, withstands exposure to changes in the surrounding temperature along its length and does not require the use of castable refractories for its installation.

It is a further object of the present invention to provide a boiler protection tube with improved flow characteristics (less resistance to fluid flow) than current boiler protection tube designs.

SUMMARY OF THE INVENTION

A boiler protection tube assembly having an inner ceramic sleeve of a high-strength, heat resistant ceramic material with at least moderate thermal shock resistance. The inner ceramic sleeve has an inner end insertable into an end of a condenser tube of a tube sheet boiler adjacent a hot face of the boiler. The inner ceramic sleeve further has an outer end opposite the inner end with a flange extending radially outwardly from the outer end.

The assembly further includes a ceramic-block of a lightweight, low thermal conductivity heat resistant ceramic material. A hole extends generally axially through the ceramic block between generally parallel inner and outer faces. The inner ceramic sleeve is insertable through the hole.

An outer recess extends into the outer face of the ceramic block about the hole and registers with the flange on the inner ceramic sleeve to stop the inner ceramic sleeve from passing entirely through the hole.

An inner recess extends about the inner face of the block to accommodate the end of the condenser tube and allow the inner face of the ceramic block to abut the tube sheet adjacent its hot face.

Each of the ceramic blocks has a plurality of side faces generally perpendicular to the inner and outer faces, the number and size of the side faces being selected to enable the blocks to be installed with the side faces adjacent to corresponding side faces of adjacent blocks.

The tube assembly also includes an outer ceramic sleeve of a heat resistant insulating ceramic fiber which extends around the inner ceramic sleeve, substantially along the entire length of the inner ceramic sleeve between the flange and the inner end. The outer ceramic sleeve is insertable into the hole through the ceramic block along with the inner ceramic sleeve to reduce heat flow between the inner ceramic sleeve and both the block and the condenser tube.

DESCRIPTION OF DRAWINGS

The background to the invention has been described above and preferred embodiments of the invention are described below with reference to the accompanying drawings in which.

DESCRIPTION OF PREFERRED EMBODIMENTS

Ceramics can be optimized either for high strength or for high resistance to heat flow (low thermal conductivity).

Although ceramic materials may have the ability to withstand great temperatures, the materials (such as metal oxides) generally do not provide as good a resistance to heat flow as do air and other gasses. To optimize a ceramic for high-resistance to heat flow it is necessary to introduce voids, usually gas filled, in a ceramic material to take advantage of the high resistance to heat flow of the gasses. This has a deleterious effect on strength as it reduces the amount of ceramic per unit area and introduces numerous crack initiation sites. Ceramics with high resistance to heat flow therefore have relatively low tensile and compressive strength due to the high volume of pores in the structure.

In the present application, a boiler protection tube should have both high resistance to heat flow to enable the steel structure to operate as cooly as possible and provide sufficient strength to support the refractory adjacent the hot face 38 of the tube sheet 30. The prior art designs of the sleeve and block type described above have all utilized the same ceramic material for the sleeve as for the block. Accordingly the block in the prior art designs is not optimized for high resistance to heat flow and low weight resulting in undue stresses being placed on the sleeve arising from the weight of the block.

Figure 2:
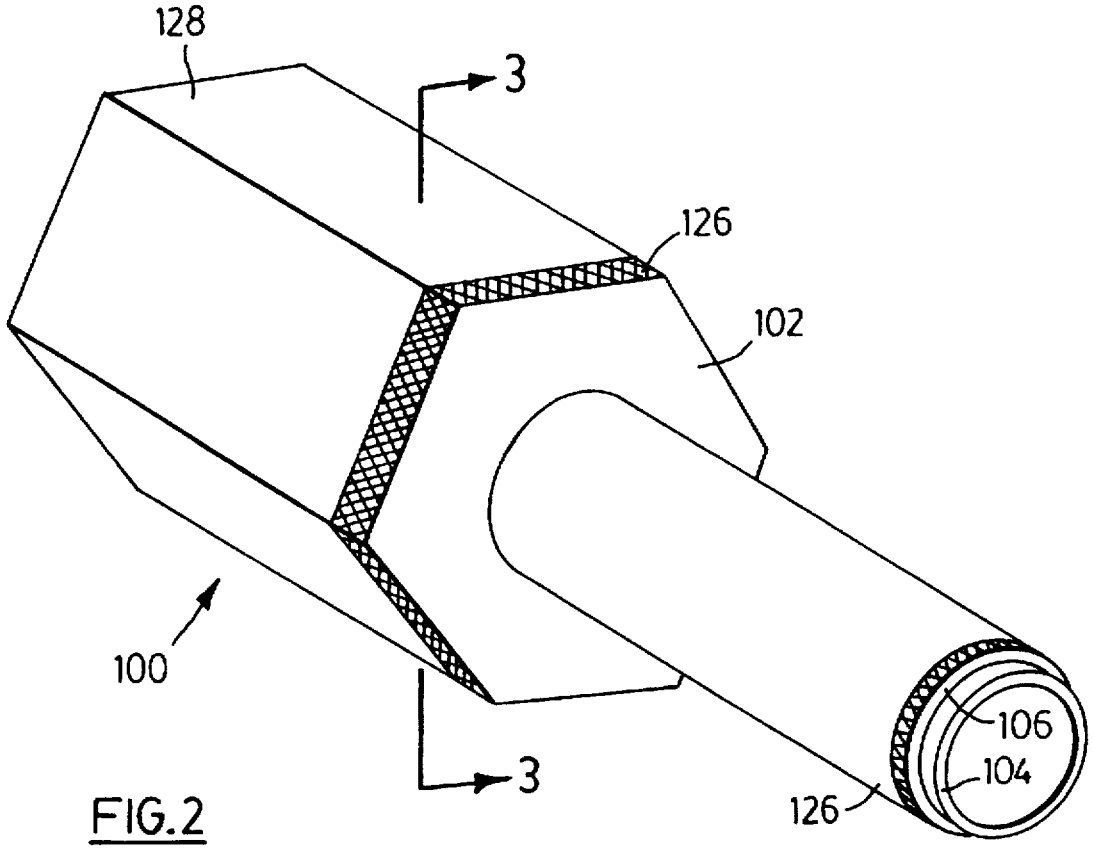
FIG. 2 is a perspective view of a boiler protection tube assembly according to the present invention.

FIG. 2 generally illustrates a boiler protection tube according to the present invention at reference 100. The boiler protection tube assembly is shown in use in FIG. 3 which is a partially cut-away view of a section of a tube sheet boiler and shows the end of a condenser tube 18 and part of a tube sheet 30. The boiler protection tube assembly 100 has an inner ceramic sleeve 104 of a high strength, high thermal shock resistance ceramic material which has at least a moderate amount of thermal shock resistance. An outer ceramic sleeve 106 of a high temperature insulating ceramic fiber surrounds the inner ceramic sleeve 104 along most of its length.

The inner ceramic sleeve 104 together with the outer ceramic sleeve 106 is insertable through a ceramic block 102 having a hole 108 extending generally axially therethrough between an outer face 110 and an inner face 114. The ceramic block 102 is of a low thermal conductivity, light weight ceramic material to minimize both the heat flow to the hot face 38 of the tube sheet and the weight to be supported by the inner ceramic sleeve 104. The inner and outer ceramic sleeves, 104 and 106 respectively, extend through the hole 108 in the ceramic block 102 into an end 112 of the condenser tube 18 adjacent the hot face 38 of the tube sheet 30.

Figure 3:
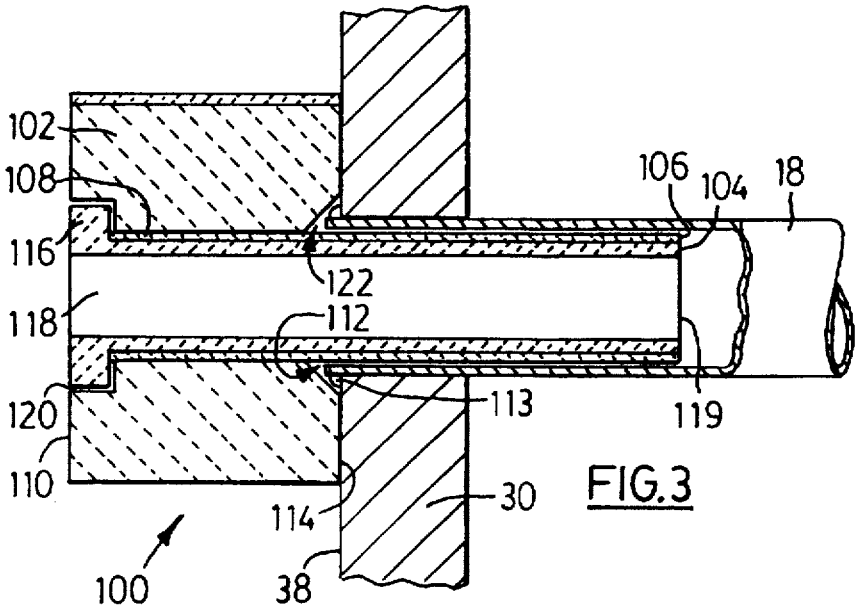
FIG. 3 is a section on line 3—3 of FIG. 2 of a boiler protection tube assembly according to the present invention mounted in a cut-away section of a boiler.

The inner ceramic sleeve 104 has an outwardly extending flange 116 at an outer end 118 to the left in FIG. 3. The outer end 118 is opposite an inner end 119 which is inserted into the condenser tube 18. The flange 116 registers with an outer recess 120 extending into the outer face 110 of the ceramic block 102 about the hole 108 to stop the inner ceramic sleeve 104 from passing entirely through the hole 108.

The ceramic block 102 has an inner recess 122 extending into the inner face 114 about the hole 108 to accommodate the end 112 of the condenser tube and any associated weld 113 which typically protrudes slightly from the hot face 38 of the tube sheet 30.

Figure 4:
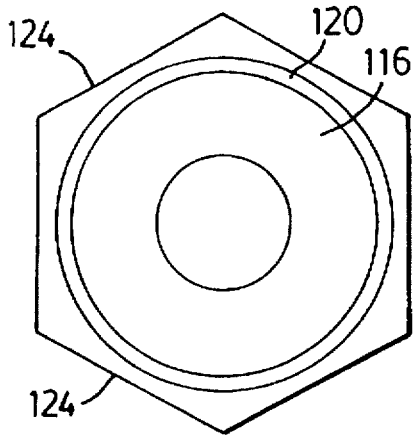
FIG. 4 is an end elevation of a boiler protection tube assembly according to the present invention; and, FIG. 5 is a view corresponding to FIG. 3 of a boiler protection tube assembly according to the present invention having improved flow characteristics.

The ceramic block 102 is illustrated in FIGS. 3 and 4 as having six side faces 124 generally perpendicular to the inner and outer faces, 114 and 110 respectively. In use the boiler protection tube assemblies are arranged in a manner similar to that illustrated in FIG. 1*e* so that the side faces 124 lie adjacent to corresponding side faces 124 of adjacent ceramic block 102. The number of side faces 124 and dimensions of the ceramic blocks are selected to correspond to the layout of the condenser tubes 18 as in the prior art assembly 52 illustrated in FIG. 1*f* and discussed in the background above.

The use of a light weight, low thermal conductivity ceramic material for the block 102 of the present invention reduces heat flow into the hot face 38 of the tube sheet 30 and provides significantly less weight to be carried by the inner ceramic sleeve 104.

As mentioned above, the use of a high strength ceramic material for the inner sleeve 104 optimizes the ability of the inner ceramic sleeves 104 to support the ceramic blocks 102.

The use of a high temperature ceramic insulating fiber for the outer ceramic sleeve 106 and having the outer ceramic sleeve 106 extend substantially along the entire length of the ceramic inner sleeve 104 (rather than just that portion of the inner sleeve 104 which protrudes into the condenser tube 18 as in the prior art design) reduces heat flow through the ceramic sleeve 104 into both the ceramic block 102 and the condenser tube 18. This minimizes any thermal gradient along the inner ceramic sleeve 104 which would otherwise be increased by the combination of a low thermal conductivity ceramic block 102 and the high thermal conductivity of the condenser tube 18. Accordingly, thermal stresses along the inner ceramic sleeve 104 are minimized to reduce the possibility of thermal stress induced cracking and to enable the use of a high strength thermally conductive ceramic material having moderate thermal shock resistance.

Table 1 below sets out typical compositions and physical properties of representative ceramic materials suitable for use in the inner ceramic sleeve 104.

TABLE 1

| MATERIAL SPECIFICATIONS | | ZIRCON | 85% ALUMINA | 90% ALUMINA | 99% ALUMINA |
|---|---|---|---|---|---|
| CHEMICAL ANALYSIS - $ZrO_2$ | percent | 46.00 | — | 0.39 | — |
| $Al_2O_3$ | | 12.00 | 85.00 | 89.40 | 99.00 |
| $SiO_2$ | | 36.00 | 12.80 | 9.50 | 1.00 |
| $Fe_2O_3$ | | 0.34 | 0.34 | 0.38 | — |
| $TiO_2$ | | 0.37 | 0.37 | 0.31 | — |
| $Na_2O$ | | 0.14 | 0.14 | 0.02 | — |
| CaO | | | 0.09 | — | — |
| SERVICE TEMPERATURE | BS-1901 | 2900 | 3200 | 3270 | 3500 |
| PYROMETRIC CONE EQUIVALENT (PCE) | ASTM C24-84 | 32 | 37–38 | 38+ | 40+ |
| REFRACTORINESS UNDER LOAD (°F.) | ASTM C16-81 | 2730 | 3040 | 3040 | N/A |
| DENSITY ($lb/ft^3$) | ASTM C-134 | 199 | 158 | 158 | 240 |
| APPARENT POROSITY (persent) | ASTM C-20 | 18 | 20 | 20 | 0 |
| THERMAL SHOCK RESISTANCE (cycles) | DIN 51068-1 | >30 | >30 | >30 | <1 |
| THERMAL EXPANSION (in/in °F.) | ASTM E-228 | $3.9 \times 10^{-6}$ | $4.4 \times 10^{-6}$ | $4.4 \times 10^{-6}$ | $5.0 \times 10^{-6}$ |

TABLE 1-continued

| MATERIAL SPECIFICATIONS | | | ZIRCON | 85% ALUMINA | 90% ALUMINA | 99% ALUMINA |
|---|---|---|---|---|---|---|
| THERMAL CONDUCTIVITY | TS-21 | 900° F. | 18 | 21 | 21.8 | 60.7 |
| (BTU in/h ft$^2$ °F.) | | 1870° F. | 12 | 15 | 16.0 | 34.0 |
| COMPRESSIVE STRENGTH (psi) | ASTM C-133 | | 7180 | 7114 | 11000 | 250000 |
| MODULUS OF RUPTURE (psi) | ASTM C-583 | 68° F. | — | 3567 | — | — |
| | | 2500° F. | 848 | 2246 | 2287 | — |
| POISSONS RATIO | TS-R-14 | | 0.38 | 0.26 | 0.26 | 0.30 |
| MODULUS OF ELASTICITY (psi) | ASTM C-885 | | $8.1 \times 10^6$ | $9.3 \times 10^6$ | $9.7 \times 10^6$ | $46.0 \times 10^6$ |
| MOE - SHEAR (psi) | ASTM C-747 | | $3.7 \times 10^6$ | $3.7 \times 10^6$ | $3.7 \times 10^6$ | $27.0 \times 10^6$ |
| ABRASION RESISTANCE (cc) | ASTM C-704 | | 5.0 | 8.90 | 5.80 | 1.20 |

Table 2 below sets out typical compositions and physical properties of representative ceramic materials suitable for use in the ceramic block 102. The ceramic fiber block 102 may also be wrapped in a ceramic fiber insulating material such as illustrated by reference 128 to seal any gaps between adjoining side faces 124 of adjoining blocks 102.

TABLE 2

| PROPERTY | TYPICAL VALUES |
|---|---|
| CHEMICAL ANALYSIS | |
| $Al_2O_3$ | 31–96% |
| $SiO_2$ | 0–48% |
| MAXIMUM SERVICE TEMPERATURE | 1200–1800° C. |
| BULK DENSITY | 1200–1450 Kg/m$^3$ |
| COLD CRUSHING STRENGTH | |
| Heated to 815° C., then cooled | 3A–10.3 MPa |
| Heated to 1095° C., then cooled | 2.7–14.0 MPa |
| MODULUS OF RUPTURE | |
| Heated to 1095° C., then cooled | 0.9–2.8 MPa |
| Heated to 1095° C., then cooled | 0.7–3.4 MPa |
| THERMAL CONDUCTIVITY | |
| 260° C. | 0.30–1.20 W/m · K |
| 540° C. | 0.30–0.94 W/m · K |
| 715° C. | 0.35–0.80 W/m · K |

Table 3 below lists the trademarks and compositions of representative ceramic fiber insulating materials suitable for use in the ceramic outer sleeve 106 and for wrapping of the ceramic block 102. To aid in inserting the ceramic outer sleeve 106 through the hole 108 in the ceramic block 102, the ceramic outer sleeve 106 may be wrapped with a friction reducing material such as tape, for example cellophane tape or a combination of tape and another wrapping material such as paper or a plastic film. A wrapping material is illustrated by reference 126 in FIG. 2. The wrapping material 126 would typically burn off in use.

TABLE 3

| PROPERTY | TYPICAL VALUES |
|---|---|
| COLOUR | White or Cream |
| TEMPERATURE | |
| Continuous Service Temperature | 2300–3300 Deg F |
| Melting (softening) Temperature | 3260–3900 Deg F |
| BULK DENSITY | 7–81 pcf |
| CHEMICAL COMPOSITION | |
| Aluminium Oxide | 0–97% |
| Silica | 2–53% |
| Zirconia | 0–94% |
| L.O.I. (Loss on Ignition) | 0–8% |
| PERCENTAGE FIBERS | 10–100% |
| THERMAL CONDUCTIVITY | |
| (Btu in/hr sq ft F) | |
| 500 Deg F | 0.04–1.00 |

TABLE 3-continued

| PROPERTY | TYPICAL VALUES |
|---|---|
| 1000 Deg F | 0.07–1.20 |
| 2000 Deg F | 0.12–2.20 |

Figure 1A:
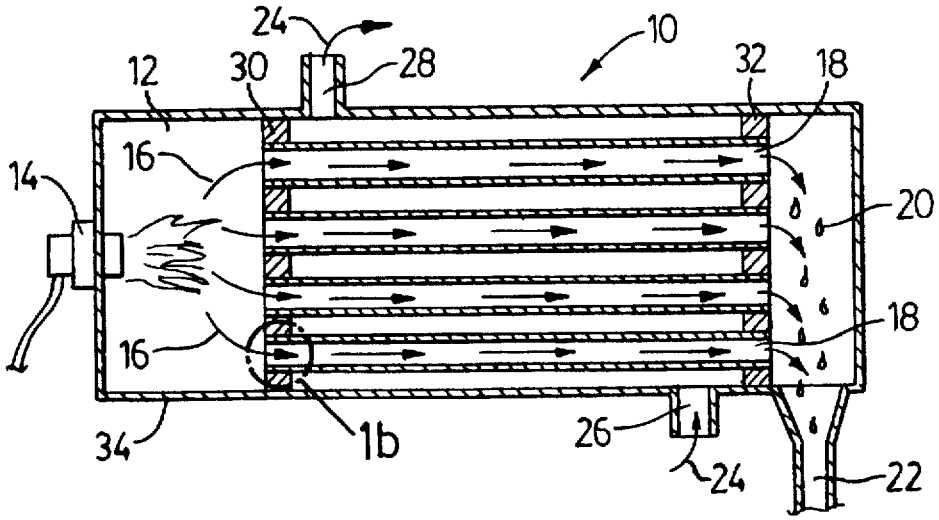
FIG. 1a (PRIOR ART)
FIG. 1*a* is a cross-sectional view schematically illustrating a tube sheet boiler.
Figure 1B:
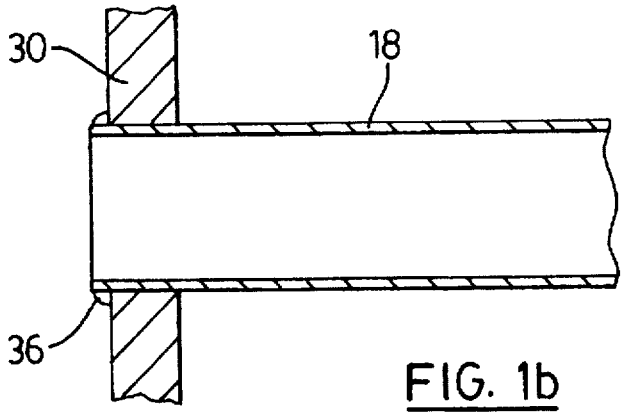
FIG. 1b (PRIOR ART)
FIG. 1*b* illustrates in more detail the encircled area 1*b* in FIG. 1*a* which is typically protected by ceramic boiler protection tubes.
Figure 1C:
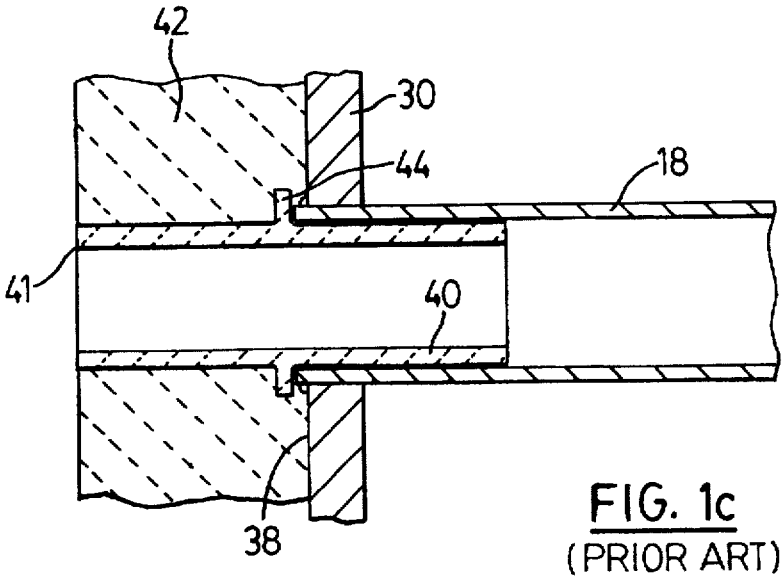
FIG. 1c (PRIOR ART)
FIG. 1*c* is a cross-sectional view illustrating a prior art ceramic boiler protection tube assembly.
Figure 1D:
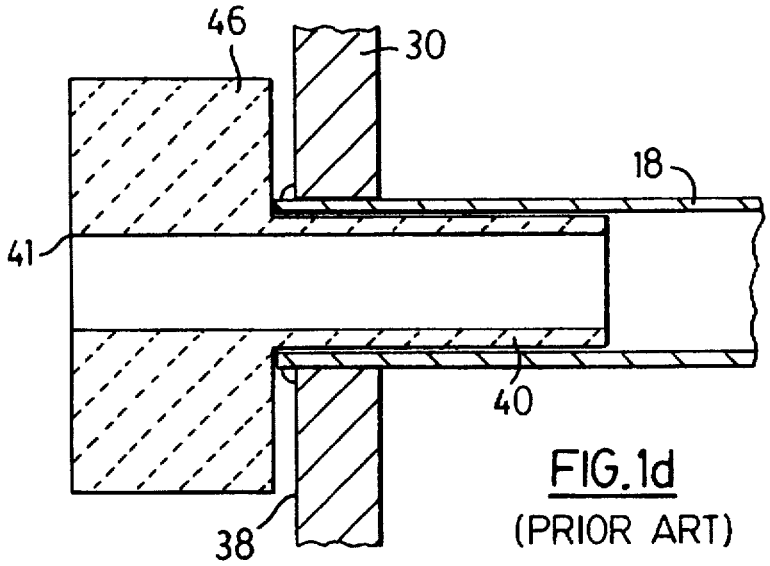
FIG. 1d (PRIOR ART)
FIG. 1*d* is a cross-sectional view illustrating a prior art ceramic boiler protection tube assembly.
Figure 1E:
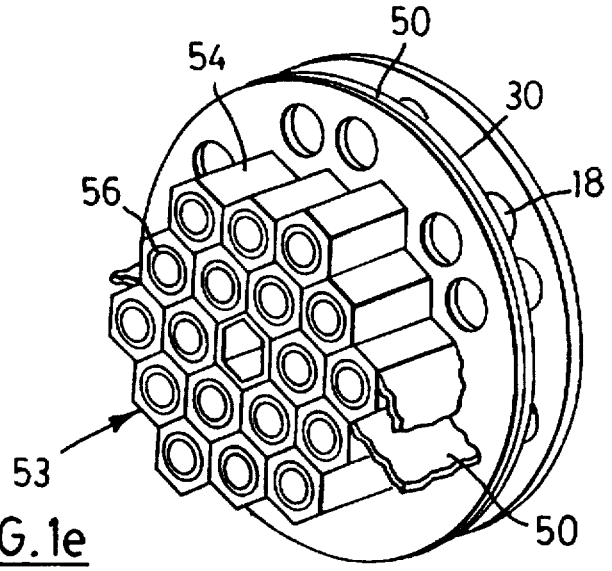
FIG. 1e (PRIOR ART)
FIG. 1*e* is a perspective view of a ceramic boiler protection tube arrangement.
Figure 1F:
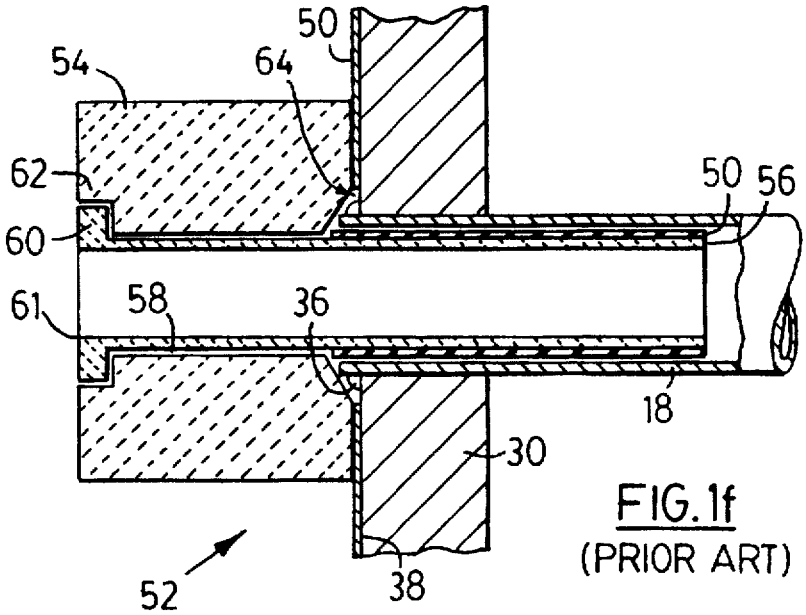
FIG. 1f (PRIOR ART)
FIG. 1*f* is a cross-sectional view illustrating a prior art ceramic boiler protection tube assembly.

Heretofore boiler protection tube assemblies of the type illustrated in FIGS. 1*c*, *d* and *f* have utilized a sharp, right-angled entry into the sleeve 40 in FIGS. 1*c* and *d* and 56 in FIG. 1*f*. Such entry is identified by reference 41 in FIGS. 1*c* and *d* and by reference 61 in Figure f. Such a sharp angle generally provides a maximum resistance to fluid flow through the sleeve.

Figure 5:
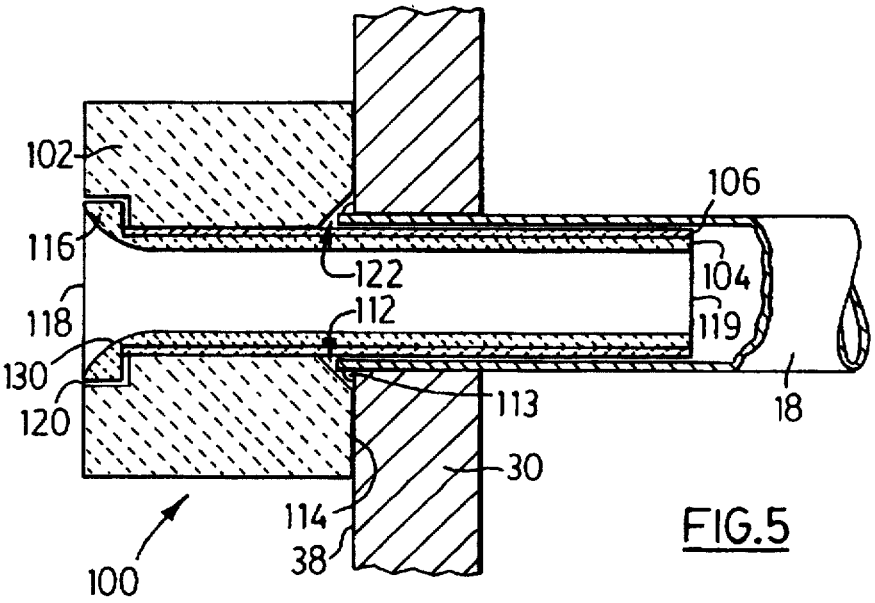

FIG. 5 illustrates an improved sleeve design wherein a curved entry profile illustrated by reference 130 is provided. A curved entry profile typically represents an impediment to fluid flow (drag co-efficient) of approximately half that of a right-angled entry profile. Preferably the curved entry profile 130 has an elliptical rather than simply radiused cross-section, nevertheless a radiused profile is preferable to a right-angled entry from the standpoint of reducing resistance to fluid flow.

The above description should be interpreted in an illustrative rather than a restrictive sense as variations may be apparent to suitably skilled persons while staying within the spirit and scope of the present invention as defined by the claims set out below.

I claim:

1. A boiler protection tube assembly comprising:

an inner ceramic sleeve of a high strength, heat resistant ceramic material with at least moderate thermal shock resistance, said inner ceramic sleeve having an inner end insertable into an end of a condenser tube of a tube sheet boiler adjacent a hot face of said boiler, an outer end opposite said inner end and a flange extending radially outwardly from said outer end;

a ceramic block of a light weight, low thermal conductivity, heat resistant ceramic material, said ceramic block having a hole extending generally axially therethrough between generally parallel inner and outer faces, said inner ceramic sleeve being insertable through said hole, an outer recess extends into said outer face about said hole and registers with said flange on said inner ceramic sleeve to stop said inner ceramic sleeve from passing entirely through said hole, an inner recess extends into said inner face of said block about said hole for accommodating said end of said condenser tube and any associated weld to allow said inner face to abut said tube sheet adjacent said hot face, each said ceramic block having a plurality of side faces generally perpendicular to said inner and outer faces, the number and size of said side faces being selected to enable said blocks to be installed with said side faces adjacent to corresponding side faces of adjacent of said blocks; and, an outer ceramic sleeve of a heat resistant insulating ceramic fiber extending around said inner ceramic sleeve substantially along the entire length of said inner ceramic sleeve between said flange and said inner end, said outer ceramic sleeve being insertable into said hole through said ceramic block along with said inner ceramic sleeve to reduce heat flow between said inner ceramic sleeve and both said ceramic block and said condenser tube.

2. A boiler protection tube assembly as claimed in claim 1 wherein said outer ceramic sleeve is wrapped with a friction reducing material to ease insertion of said inner and outer ceramic sleeves through said hole in said ceramic block and into said end of said condenser tube.

3. A boiler protection tube assembly as claimed in claim 1 wherein said inner ceramic sleeve has a curved entry profile.

4. A boiler protection tube assembly as claimed in claim 2 or 3 wherein said ceramic block is wrapped about said side faces with a high temperature ceramic fiber insulating material and a friction reducing material.

5. A boiler protection tube assembly as claimed in claim 1, 2, or 3 wherein said block has six side faces to provide a generally regular hexagonal cross-section.

6. A boiler protection tube assembly as claimed in claim 4 wherein said block has six side faces to provide a generally regular hexagonal cross-section.

7. A boiler protection tube assembly as claimed in claim 1, 2 or 3 wherein said block has four side faces to provide a generally square cross-section.

8. A boiler protection tube assembly as claimed in claim 4 wherein said block has four side faces to provide a generally square cross-section.

* * * * *